US006173662B1

(12) United States Patent
Donovan

(10) Patent No.: US 6,173,662 B1
(45) Date of Patent: Jan. 16, 2001

(54) METHOD AND APPARATUS FOR CONTAINING AND SUPPRESSING EXPLOSIVE DETONATIONS

(76) Inventor: John L. Donovan, P.O. Box 486, Danvers, IL (US) 61732

( * ) Notice: Under 35 U.S.C. 154(b), the term of this patent shall be extended for 0 days.

(21) Appl. No.: 09/191,045

(22) Filed: Nov. 12, 1998

Related U.S. Application Data

(63) Continuation-in-part of application No. 08/823,223, filed on Mar. 24, 1997, now Pat. No. 5,884,569, and a continuation-in-part of application No. 08/578,200, filed on Dec. 29, 1995, now Pat. No. 5,613,453.

(51) Int. Cl.[7] ..... F23G 7/00; F23N 5/24; F42B 33/00

(52) U.S. Cl. ..... 110/237; 110/193; 110/215; 110/240; 110/346; 86/50; 588/202; 588/900

(58) Field of Search ..... 29/421.2; 72/54, 72/56, 706; 86/50; 109/27, 29, 36; 110/193, 215, 237, 240, 241, 242, 346; 588/202, 900

(56) References Cited

U.S. PATENT DOCUMENTS

| | | | |
|---|---|---|---|
| 3,408,432 | | 10/1968 | Tumm et al. . |
| 3,464,249 | | 9/1969 | Klein . |
| 3,485,075 | | 12/1969 | Kiselev et al. . |
| 3,611,766 | | 10/1971 | Klein et al. . |
| 3,721,201 | * | 3/1973 | Boller . |
| 3,793,101 | | 2/1974 | Mullarkey . |
| 3,800,715 | * | 4/1974 | Boller . |
| 3,903,814 | | 9/1975 | Alterkruse . |
| 3,910,084 | | 10/1975 | Paton et al. . |
| 3,915,104 | | 10/1975 | Hapgood et al. . |
| 4,027,601 | | 6/1977 | Hickerson . |
| 4,079,612 | | 3/1978 | Smirnov et al. . |

(List continued on next page.)

FOREIGN PATENT DOCUMENTS

| | | |
|---|---|---|
| 0315616 | 5/1989 | (EP) . |
| 2608268 | 6/1988 | (FR) . |

OTHER PUBLICATIONS

Joe Serena "Blast containment structure passes proof test" *Ordnance Explosives Environment*, Apr.–Jun. 1996.

Joseph M. Serena "Development of an On–Site Demolition Container for Unexploded Ordnance" presented at the Global Demilitarization Symposium and Exposition, May 13–17, 1996.

USSR, 1995—Palamarchuk, Malakhov, Cherkashin, and Petushkov; Shock Waves and Their Suppression by Foam in Explosive Treatment of Welded Joints; Jan., 1995; in Russian.

*Primary Examiner*—Ira S. Lazarus
*Assistant Examiner*—Ljiljana V. Ciric
(74) *Attorney, Agent, or Firm*—Bullwinkel Partners, Ltd.

(57) ABSTRACT

A mobile apparatus, and method of operation, for controlling and suppressing the explosive destruction of munitions by detonation in an explosion chamber. The apparatus comprises a double-walled steel explosion chamber which is moved by wheeled carriage means to a desired location. Granular shock-damping silica sand is introduced into fillable cavities within the chamber walls, ceiling and floor prior to use. After use, the sand is removed to lighten the chamber prior to transport. The floor of the chamber is covered with granular shock-damping pea gravel which may be added before use and removed before further transport. A munition to be destroyed is placed within an open-topped steel fragmentation containment unit. Vaporizable plastic bags of energy-absorbing water are disposed about the munition in a spaced array. An array of vent pipes vents the chamber into manifolds leading to an expansion tank or scrubber for further cooling and environmental treatment of the explosion products.

21 Claims, 7 Drawing Sheets

U.S. PATENT DOCUMENTS

| | | | |
|---|---|---|---|
| 4,081,982 | | 4/1978 | Minin et al. . |
| 4,085,883 | | 4/1978 | Deribas et al. . |
| 4,100,783 | | 7/1978 | Gambarov et al. . |
| 4,174,624 | | 11/1979 | Shrum . |
| 4,248,342 | | 2/1981 | King et al. . |
| 4,325,309 | | 4/1982 | King et al. . |
| 4,478,350 | | 10/1984 | Ohlsson . |
| 4,632,041 | | 12/1986 | Ohlson . |
| 4,686,911 | | 8/1987 | Phillips . |
| 4,781,145 | | 11/1988 | Amlinsky et al. . |
| 4,836,079 | | 6/1989 | Barrett . |
| 4,875,420 | | 10/1989 | Hay et al. . |
| 4,879,890 | | 11/1989 | Hardwick . |
| 5,044,252 | | 9/1991 | Gamadi et al. . |
| 5,339,666 | | 8/1994 | Suzuki et al. . |
| 5,419,862 | | 5/1995 | Hampel . |
| 5,458,071 | | 10/1995 | Tadmor et al. . |
| 5,495,812 | | 3/1996 | Schulze . |
| 5,613,453 | | 3/1997 | Donovan . |
| 5,668,342 | | 9/1997 | Discher . |
| 5,792,978 | * | 8/1998 | Woodall, Jr. et al. . |
| 5,875,996 | * | 3/1999 | Borgia . |
| 5,884,709 | * | 3/1999 | Evans et al. . |

* cited by examiner

METHOD AND APPARATUS FOR CONTAINING AND SUPPRESSING EXPLOSIVE DETONATIONS

I, John L. Donovan, have invented certain new and useful improvements in a METHOD AND APPARATUS FOR CONTAINING AND SUPPRESSING EXPLOSIVE DETONATIONS of which the following is a specification. This application is a continuation-in-part of my application Ser. No. 08/823,223 filed Mar. 24, 1997, now U.S. Pat. No. 5,884,569. The latter application is a continuation-in-part of Ser. No. 08/578,200 filed Dec. 29, 1995, which issued Mar. 25, 1997 as U.S. Pat. No. 5,613,453.

FIELD OF THE INVENTION

This invention relates to a method and apparatus for containing, controlling and suppressing the detonation of explosives, particularly for the explosion working of metals, and for the disposal of unwanted explosive munitions and toxic materials.

BACKGROUND OF THE INVENTION

Explosives have many useful industrial applications including surface hardening of austenitic manganese alloy steels, surface deposition coating, welding of metallic components, compression molding of components from powders and granular media, and disposal of unwanted explosive or toxic materials.

The prior art reflects many attempts to contain the explosion process for the suppression of noise, shock and noxious polluting explosion products.

Hampel 5,419,862 discloses a large explosion chamber in which an explosive work piece is introduced in through an air lock into a vacuum chamber where it is detonated, and after detonation the explosion products are allowed to escape into the atmosphere. The chamber is mechanically secured by anchor rods to a foundation.

Gambarov, et al. U.S. Pat. No. 4,100,783 discloses a cylindrical containment vessel, split along its diameter for separation, and openable for the insertion of large work pieces such as railway frogs, stone crusher wear parts and the like. After insertion of a work piece and explosive charge, the chamber is closed and locked and the explosive detonated by a built-in detonating device. The explosion combustion products are allowed to exhaust to the atmosphere through an air valve.

Deribas U.S. Pat. No. 4,085,883 and Minin U.S. Pat. No. 4,081,982 disclose spherical containment vessels with a bottom opening through which a work piece incorporating an explosive is introduced through an elevator means, and continuous feed wire electrodes are used to make contact with an electrically initiated detonator when the work piece is in place. The latter patent also discloses means for introducing an internal liquid spray after the explosion for the purpose of neutralizing toxic by-products of the explosion.

Smirnov, et al. U.S. Pat. No. 4,079,612 discloses a roughly hemispherical containment vessel mounted on a concrete foundation with a shock-absorbing work table for supporting the work piece and explosive material, which are detonated through electric ignition wires leading through openings in the containment vessel to the outside.

A different approach is disclosed by Paton, et al. U.S. Pat. No. 3,910,084 in which multiple closed-end pipes are disposed radially around a central column in-which the explosion is initiated, with the shock waves dampened by internal baffles within the tubes. Access is gained to the chamber through a removable top cover plate.

Klein, et al. U.S. Pat. No. 3,611,766 discloses a vertical explosion chamber incorporating a cushioned work table for supporting the work piece and explosive charge, and an internal shock-mounted mechanical dampening means consisting of a steel grate for absorbing the explosive pressure waves. Klein U.S. Pat. No. 3,464,249 discloses a similar containment vessel, in this case spherical, with a bottom covering of loose granular material such as sand which supports the work piece and explosive charge. The explosion products are discharged through a vertical pipe containing a noise silencer, and the entire assembly is supported by shock absorbing means in a reinforced brick or concrete pit for the further suppression of shock and noise.

All of the above prior art devices represent improvements over the methods first used for explosion hardening of manganese steel rail components which involved placing the explosive-covered work piece in an open field, or at the bottom of an open pit such as an abandoned gravel pit, and setting off the explosion in the open air with resultant noise, dust, disturbance and contamination of the environment. In addition, the uncontrolled use of explosives required great amounts of space, posed substantial danger to equipment and personnel, and had the undesirable effect of demolishing the ignition leads, the work piece support surface, and everything else within the immediate vicinity of the explosion.

It is therefore the principal object of the present invention to provide an improved method and apparatus for containing, controlling and suppressing the effects of explosive detonations used for industrial purposes. The purpose of the invention is to provide a containment device which can contain and suppress each explosion so that it poses no hazard to surrounding plant and equipment, or to the environment.

A further object is to provide such a method and apparatus which permits rapid and convenient charging and removal of work pieces, thereby achieving much higher rates of production than have been possible using prior art devices and techniques. A related object is to provide an explosive containment vessel which can be constructed inexpensively of common materials using conventional welding techniques but which is sturdy enough to withstand months and years of continuous use without deterioration. A related object is to provide such a device in which inexpensive consumable materials, such as silica sand and pea gravel, are used as damping and shock absorbing agents, rather than complex and expensive internal springs, metal grates, and the like.

Another object is to provide an explosion containment chamber which is readily opened from one end to allow charging and removal of work pieces by conventional means such as a forklift truck, and to allow easy entrance and exit by maintenance personnel. A further object is to provide quick and efficient removal of gaseous explosion by-products after detonation so that maintenance personnel can immediately enter the chamber to remove the treated work piece and put another in place for the next operation.

Still another object is to provide an internal ignition system in which the electrical leads for the detonation initiation system are protected from blast effect and are reusable for a great number of explosion cycles, rather than being destroyed and having to be replaced after each cycle.

Another principal object of the invention is to provide a means of quickly removing and treating the gaseous explosion by-products by passing them through a scrubber system, so that operating personnel can re-enter the chamber immediately while the scrubber continues to process the products of the previous explosion as a new work piece and explosive charge are being readied. Also, it is an object of the scrubber system to further dampen and suppress shock and noise from each detonation by virtue of the extended travel path of the explosion products as they pass through the scrubber.

A particularly important object of the invention is to provide a simple and inexpensive means for absorbing the unused energy of the explosion, for instantaneously reducing temperatures and pressures within the chamber, while at the same time suppressing dust and particulate matter in the explosion by-products.

Still another principal object of the invention is to provide a method and apparatus for controllably destroying munitions containing multiple explosive units (cluster bomb weapons) by detonation.

Yet another principal object of the invention is to make the explosion-containing apparatus portable so that it can be moved from one location to another by conventional motorized transport means.

SUMMARY OF THE INVENTION

The improved explosion chamber of the invention comprises a double-walled steel explosion chamber anchored to a concrete foundation, and having a double-walled access door for charging new work pieces, and a double-walled vent door for discharging the products of the explosion. The double walls of the chamber, access door and vent door are filled with granular shock damping material such as silica sand, and the floor of the chamber is covered with granular shock-damping bed such as pea gravel.

Along the outside of the chamber are steel manifolds from which a linear array of vent pipes penetrates the double walls of the chamber, with each pipe terminating in a hardened steel orifice through which the explosion combustion products pass.

Within the chamber, pre-measured containers of an energy-absorbing medium, preferably comprising plastic polymer film bags containing water are suspended from steel wires over the explosive material, and at each end of the chamber. Electrical igniter lead wires enter the chamber through a steel hood having a downward-facing access opening positioned in a protected location below the surface of the granular bed, but accessible by an operator for quickly attaching an electrical blasting cap.

The access and vent door are interlocked with the electrical igniter to block ignition unless both doors are positively shut. When the doors are opened after a detonation, a vent fan is positioned to exhaust explosion combustion products from the chamber and to draw fresh air in through the access door. The manifolds and vent door discharge into a scrubber for further cooling and environmental treatment of the gaseous combustion products.

The method of operation of the invention comprises the steps of placing an explosive work piece through the access door and onto the granular bed, suspending plastic bags containing an amount of water approximating the weight of explosive, attaching an electrical blasting cap to the igniter lead wires, closing the access and vent door, electrically detonating the explosive, immediately opening both access and vent door, and using fan means for exhausting the combustion products of the detonation from the chamber in preparation for inserting the next explosive work piece.

The gaseous combustion products exiting the manifolds and vent discharge are then cooled and environmentally treated in a scrubber before being released to the atmosphere.

When used to dispose of munitions, a fragmentation containment unit ("FCU") is used. The FCU is a heavy-walled bucket-shaped casting, preferably of manganese steel, having at its bottom a bed of silica sand onto which the munition is placed, supported by one or more layers of gypsum board. Over the FCU, suspended from the roof of the chamber, is a conventional steel cable or chain blast mat. The munition is detonated by a starter charge, and the FCU and blast mat absorb the impact of any fragments or shrapnel, and the chamber then serves to absorb the remaining energy of the blast and to dissipate the explosion combustion products in the manner described above.

In another embodiment of the invention, the explosion chamber is sized to be transportable on rails or on public roads, and is provided with attachment points at each end whereby it may be picked up and attached to wheeled carriage means. In use, the chamber is transported in an empty condition to the work site, where after it has been lowered into position, its hollow walls are filled with flowable silica sand. Before use, its interior bed is filled with granular shock-absorbing material. If fragmentation munitions are to be destroyed, a shrapnel-resistant fragmentation containment unit ("FCU") is positioned on the granular bed within the chamber. After use, the chamber is lightened by removing the granular material from the bed of the chamber, and by allowing the silica sand to flow out of the hollow walls. In its lightened condition, the chamber may then be picked up and re-mounted on its carriage means for transport to another location.

A BRIEF DESCRIPTION OF THE DRAWINGS

DETAILED DESCRIPTION OF THE INVENTION

Figure 1:
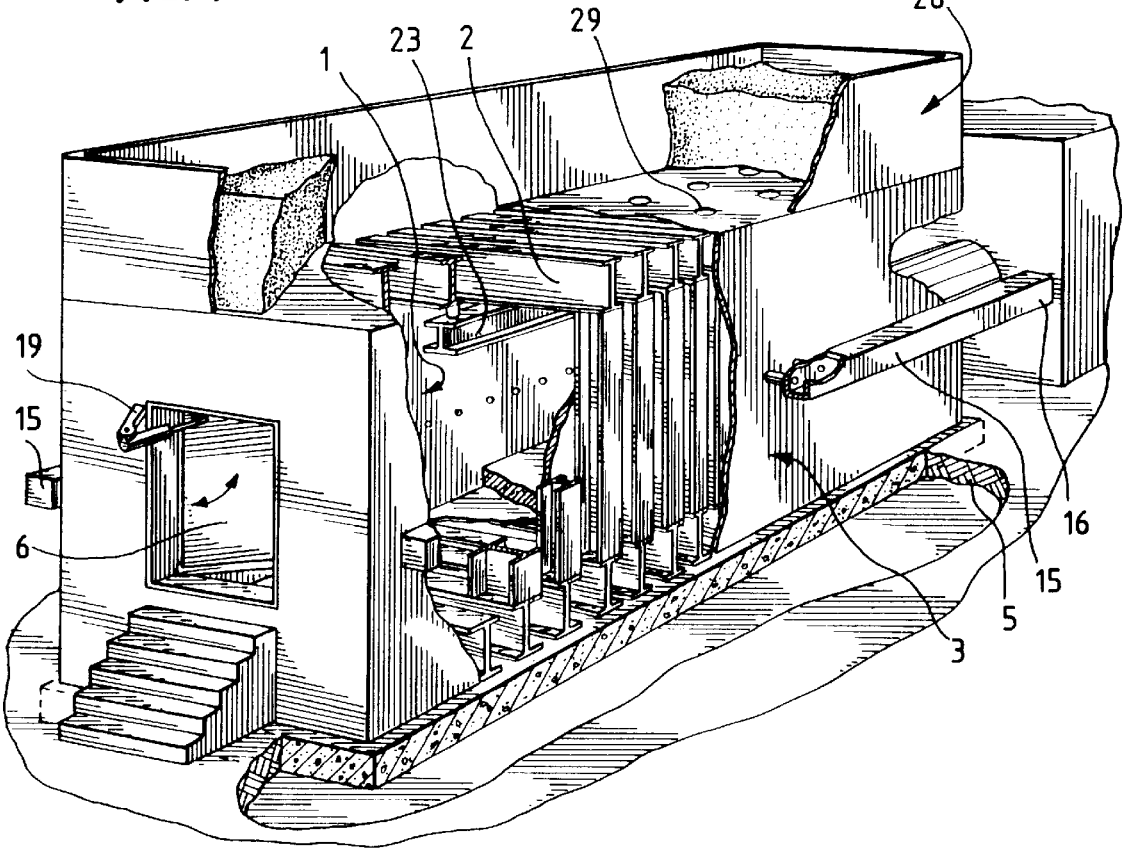
FIG. 1 is a cut-away perspective view of a first preferred embodiment of the improved explosion containment chamber of the present invention.
Figure 2:
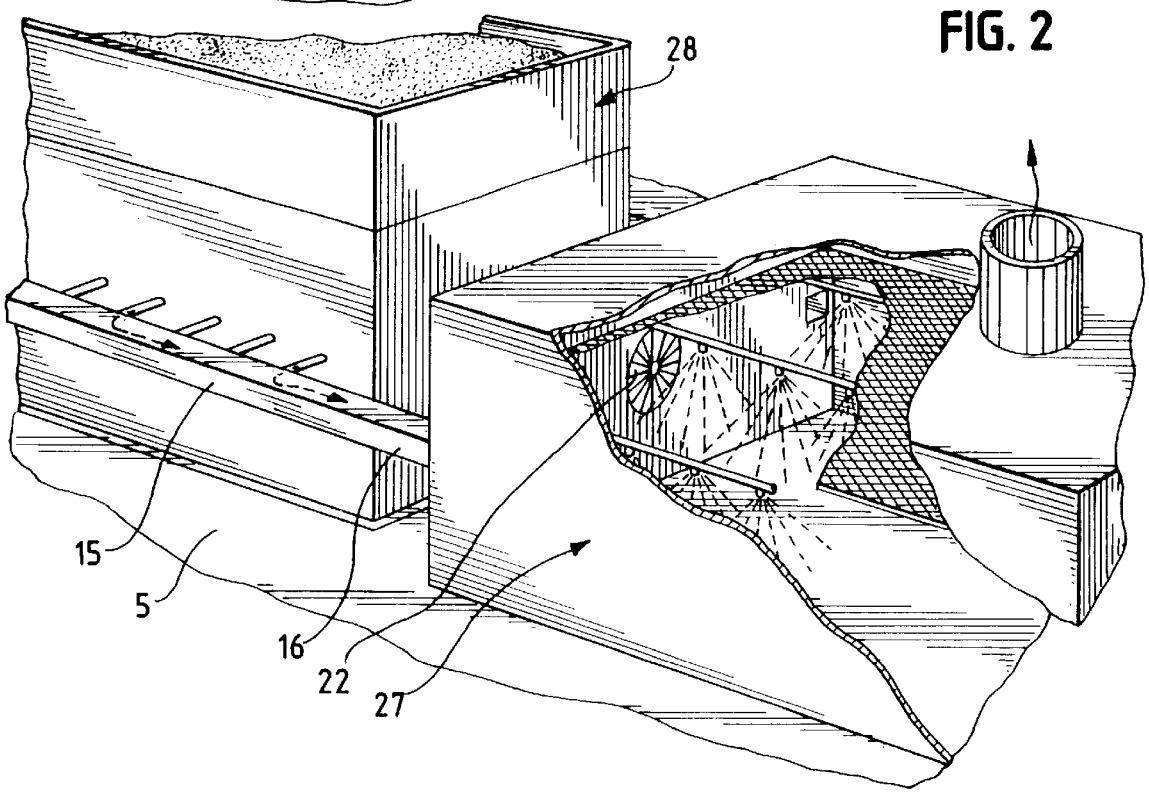
FIG. 2 is a cut-away partial perspective view of the opposite end of the chamber of FIG. 1, including a scrubber for cleaning the gaseous explosion products before venting them to the atmosphere.
Figure 3:
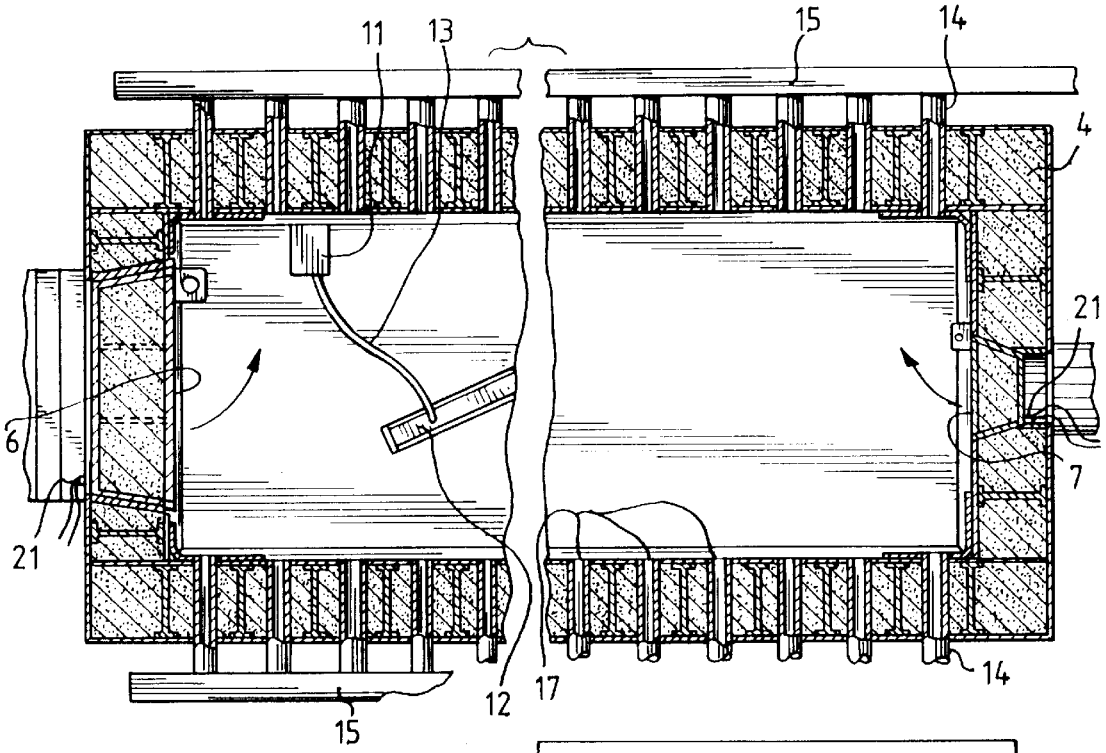
FIG. 3 is a partial sectional plan view of the explosion chamber of the preceding figures.
Figure 5:
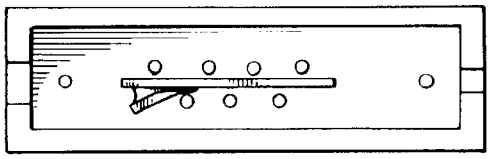
FIG. 5 is a reduced-scale sectional plan view of the full length of the explosion chamber of the preceding figures showing a railroad track work piece in place for explosion hardening treatment.
Figure 4:
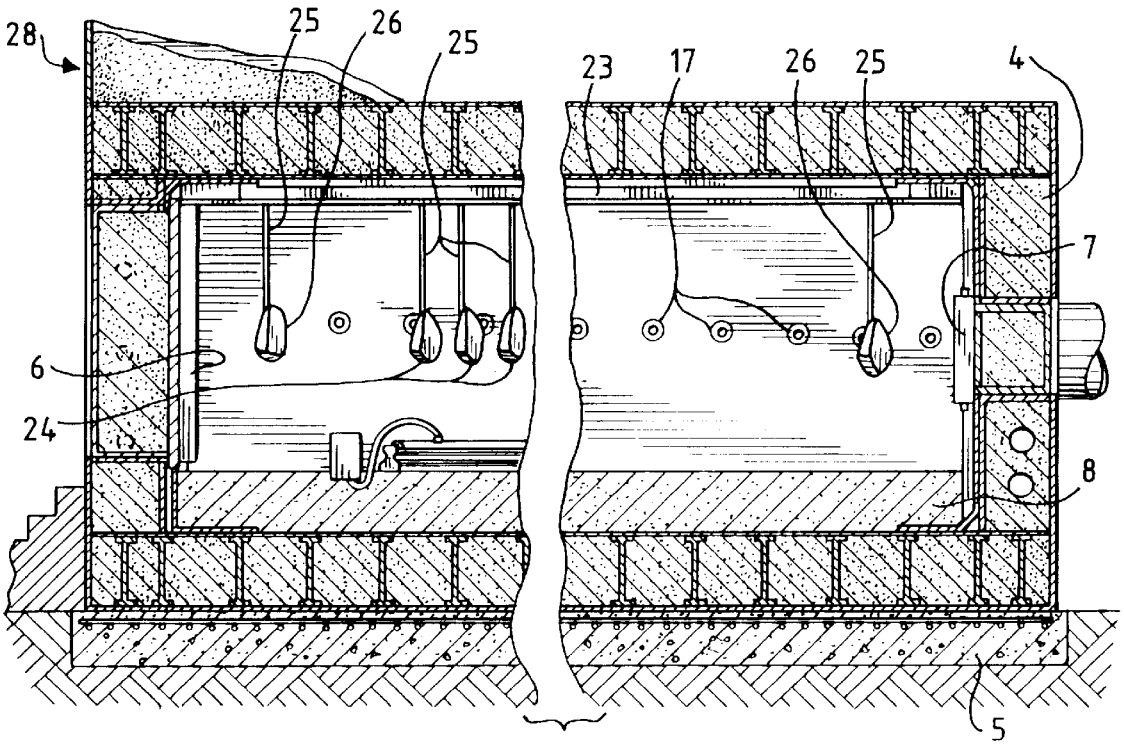
FIG. 4 is a partial sectional side elevation of the explosion chamber of the preceding figures.
Figure 6:
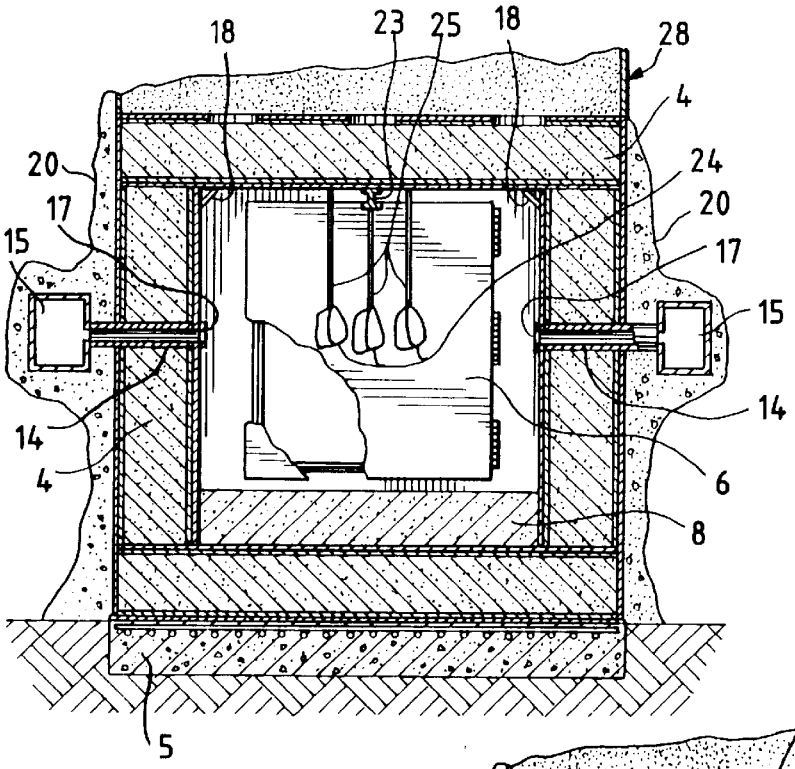
FIG. 6 is a sectional end elevation showing the access door 6 end of the explosion chamber of the preceding figures.
Figure 7:
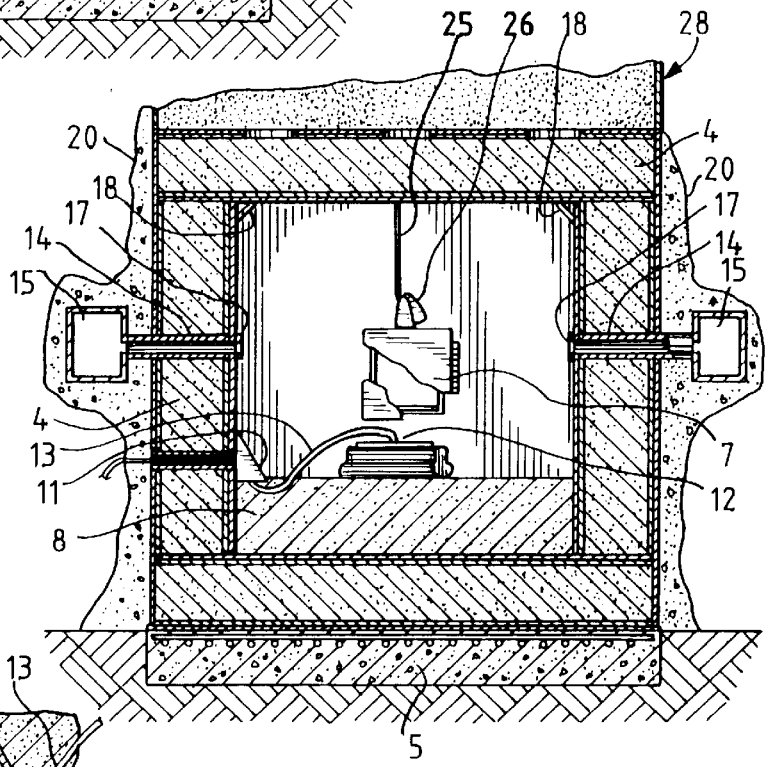
FIG. 7 is a sectional end elevation showing the vent door 7 end of the explosion chamber of the preceding figures, with a piece of rail trackwork in place for treatment.
Figure 8:
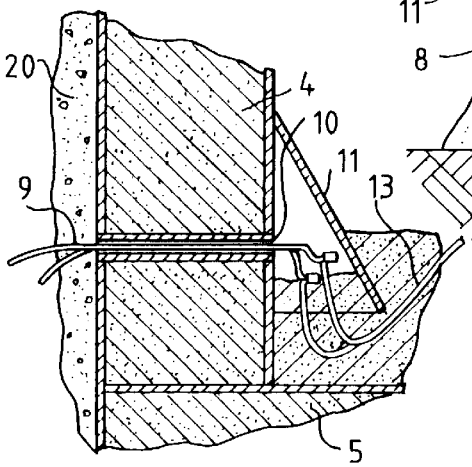
FIG. 8 is an enlarged partial sectional end elevation of the ignition wire entry point into the explosion chamber of the preceding figures.

Turning to the drawings, FIG. 1 is a sectional perspective of the improved explosion chamber of the present invention. The chamber comprises an inner casing 1 having a ceiling, floor, side walls and ends, being fabricated of sheet steel using conventional welding techniques. Surrounding the inner casing 1 are a plurality of spaced circumstantial flanges or ribs 2 over which a welded sheet steel outer casing 3 is constructed so that the ribs 2 cause the outer casing 3 to be spaced from the inner casing 1 and leaving a gap which is then filled with a granular shock-damping material. In the first preferred embodiment as shown in FIGS. 1–8, which embodiment is particularly adapted for the explosion surface hardening treatment of railroad trackwork, the inner and outer metal casings are constructed of three-quarter inch thick sheet steel separated by circumferential steel I-beam ribs 2 spaced every two feet. All seams are continuous-welded. According to the invention, the space between the inner and outer casing 3 is filled with a firm, granular shock-absorbing material, preferably silica sand.

The explosion chamber is anchored by bolts or other suitable means (not shown) to a reinforced concrete foundation 5. In the preferred embodiment shown, the inside dimensions of the explosion chamber are: eight feet high, six feet wide, and fifty feet long. The reinforced concrete foundation 5 is preferably at least four feet thick.

As one of the major advantages of the invention, the internal dimensions of the chamber allow an operator to enter, stand up and work easily, and its length, in the first preferred embodiment, permits long pre-welded sections of railroad trackwork to be inserted and explosion-hardened, which was not possible in prior art explosion chambers.

The chamber is provided with two doors, an access door 6, and a vent door 7. Both doors are constructed of double-walled welded steel similar to the chamber walls, and each is hinged to open in an inward direction. The door jambs are constructed so that each door fits in a sealing relationship so that increased pressure within the chamber causes the door to seal tighter against its frame. The volume within the double-walled doors is also filled with shock-damping material, preferably silica sand.

The floor of the chamber is preferably covered with a bed 8 of granular shock-damping material, preferably pea gravel, to a uniform depth of about one foot, thereby forming a support surface for the work piece and explosive to be detonated.

To initiate ignition of the explosive, electrical wire firing leads 9 penetrate the chamber through a pressure-sealed opening 10 and emerge through a welded sheet steel shield box or hood 11 having a downward-facing opening positioned below the surface of the granular shock-damping material. To prepare the work piece and charge for detonation, a suitable electric detonator cap 12 is inserted into the explosive charge and the ends of its wire leads 13 are routed over to the firing wire hood 11. The pea gravel is scooped away to expose the ends of the firing wire leads 9, the leads are twisted together to complete the firing circuit, and then the pea gravel is swept back over the detonator cap leads 13 to again surround and enclose the open end of the hood 11. While the detonator cap leads 13 are substantially disintegrated by the explosion, the firing wire leads 9 remain protected under the hood 11 and may be re-used repeatedly.

As a principal feature of the invention, shock suppression means are provided for the chamber in the form of a plurality of vent pipes disposed along the centerline of one or more of the interior side walls of the chamber, with each vent pipe communicating through the chamber double wall into an elongated steel manifold 15 means extending alongside the chamber on each side and terminating in a discharge outlet 16. In the first preferred embodiment each manifold 15 is ten inches square and is fabricated by continuous-seam welding from one-half inch steel plate. The ribs 2 consist of eighteen-inch I-beam sections spaced at two foot intervals. The vent pipes 14 are of two inch diameter steel tubing, and like the ribs 2 are spaced at two foot intervals. Where it connects to the inner wall of the chamber, each vent pipe is fitted with a hardened steel orifice 17 three-quarters of an inch in diameter. In the first preferred embodiment, the fifty-foot chamber has twenty-four vent pipes 14 and orifice 17 per side, for a total of forty-eight vent pipes 14 and orifice 17 in all.

Within the chamber, square corners are avoided because of the tendency of explosives to exert unusually high pressures at such critical points. Therefore, a fillet piece 18 is welded into each corner to break the 90° square corner into two 45° angles, which has the effect of rounding the corner and eliminating stress-raising corners or pockets which would otherwise impose undesirable destructive forces on the corner welds.

In the first preferred embodiment of the invention, additional sound suppression is obtained by coating the exterior surfaces of the outer chamber and manifold 15 with a polyurethane rigid foam coating 20 of known composition to a depth of at least four inches. The entire foam-covered structure is further enclosed in an enclosure such as a sturdy wooden shed (not shown) having screened ventilating slots to permit free circulation of air.

To open and close the access and vent door 7, double-acting hydraulic cylinders 19 are provided. As a further feature of the invention, important safety objectives are realized by providing each door with sensor means 21 as part of an electrical interlock (not shown) between the access door 6, vent door 7 and ignition means, whereby the access door 6 must both be in a closed and sealed position before the ignition means can be energized. In this way it is impossible to inadvertently detonate an explosive charge prematurely before the doors are fully closed the result of which would be substantial destruction and damage to equipment such as the vent fan 22, not to mention the risk of bodily injury to operating personnel in the vicinity of the access door 6.

In the first preferred embodiment the chamber ceiling is fitted with a welded I-beam for use as a trolley to insert and remove particularly long lengths of steel trackwork or other work pieces of a similar shape.

Another principal feature of the invention is the provision for each explosion of liquid-filled energy absorption modules disposed roughly along the interior centerline of the chamber. These devices serve to cool the gaseous explosion products, and to suppress dust and debris in the chamber after each explosion.

In both of the preferred embodiments, the energy absorption devices are simple self-sealing polyethylene bags filled with water and hung on hanger wires 25 approximately along the center line of the chamber above and around the work piece and explosive charge. It has been discovered that commercially available "ZipLock" brand sandwich bags, six by eight inches in dimension and 0.002 inches (two mils) thick are satisfactory for this purpose. While water is preferable, any suitable energy-absorbing vaporizable material can also be used.

According to the invention, the volume of water placed in the chamber for each explosion is selected to be approximately equal in weight to the amount of explosive to be detonated. This volume of water is distributed among several bags which are then hung in a staggered array approximately along the center line of the chamber in the vicinity of the explosive. Preferably, the water bags 24 are hung on the hooked ends of nine-gauge steel rods welded to the ceiling of the chamber.

By using the water-filled energy absorption means, it has been found that the instantaneous theoretical pressure of the explosion is reduced by more than half, and the introduction of moisture into the chamber at the moment of detonation and thereafter has a beneficial effect of suppressing dust and cooling the explosion products instantly. In contrast to explosions without the use of the water-filled bags, the perceived impact and noise of the explosion is substantially reduced, and operating personnel are enabled to enter the chamber immediately after each detonation to remove one work piece and replace it with the next.

It has also been found in practice that the beneficial effects of the water bags 24 are enhanced if an additional water bag 26 is placed at each end of the chamber, away from the work piece, approximately four feet from the access door 6, and twelve feet from the vent door 7, although other spacings are satisfactory also.

In practice, using the water bags 24 in the manner of the invention results in the complete vaporization of both the water and the polyethylene bags, serving to absorb and suppress the undesired shock of the explosion, while leaving behind virtually no debris or residue. After each explosion, the access door 6 can be opened immediately, and all that can be seen are wisps of water vapor which are swept out the vent door 7 in the manner described further herein.

According to another important feature of the invention, all gaseous explosion by-products are quickly exhausted from the chamber in a controlled manner. After each explosion, the vent door 7 and access door 6 are simultaneously opened, the vent fan 22 is energized, and the gaseous explosion products from the chamber are drawn through the vent door 7 opening while the atmosphere in the chamber is replaced with fresh air drawn through the open access door 6. In practice, using the method and apparatus described, it has been found that the access and vent door 7 may be immediately opened after each explosion, thereby permitting operating personnel to enter the chamber immediately after each explosion to remove the treated work piece and replace it with the next.

Another major feature of the present invention is that all gaseous explosion products are controllably discharged and directed into a suitable environmental treatment means such as a scrubber 27. In the illustrated embodiment, a water-spray scrubber 27 of conventional construction is used to receive the discharge from both side-mounted manifold 15, and from the vent fan 22 as well, so that no gaseous explosion products escape to the atmosphere untreated. In addition, the tortuous path offered by the scrubber 27 creates a further level of advantageous shock and noise suppression.

To permit the refilling of gaps in the chamber walls caused by settling of the shock damping silica sand, a bin or hopper 28 is provided above the chamber with spaced openings 29 through which sand may move to replace lost volume as the sand in the walls settles or compacts with each detonation. It has been found that despite such compaction, the use of silica sand (as opposed to masonry sand) does not result in any diminishing of the shock-damping effect.

Despite the immense destructive forces of each explosive detonation, the chamber of the present invention, with its vent pipes 14 and energy absorbing liquid modules, has been found in practice to diminish the surplus destructive energy of each explosion to a point where the trolley beam 23 is virtually unaffected. Similarly, the depending wires for hanging the energy absorption water bags 24 are virtually unaffected after each blast. This allows the chamber to be used continuously, with a productive output of as many as 10 or 12 explosions per hour, which is an order of magnitude greater than permitted by any of the explosion chambers of the prior art, or by conventional open-pit explosive techniques.

In practice, with the preferred embodiment described, the method and apparatus of the present invention has been successfully utilized to safely detonate explosive charges in a wide range of sizes, ranging from two to fifteen pounds of C-2 plastic explosive (also known as PETN), with minimal amounts of shock, noise and adverse effect on the environment. Surprisingly, it has been found that business office operations in an adjoining office building only two hundred feet away from the explosion chamber can be conducted in a completely normal manner, with the explosions being indistinguishable from the ordinary background noise of the office environment.

Figure 9:
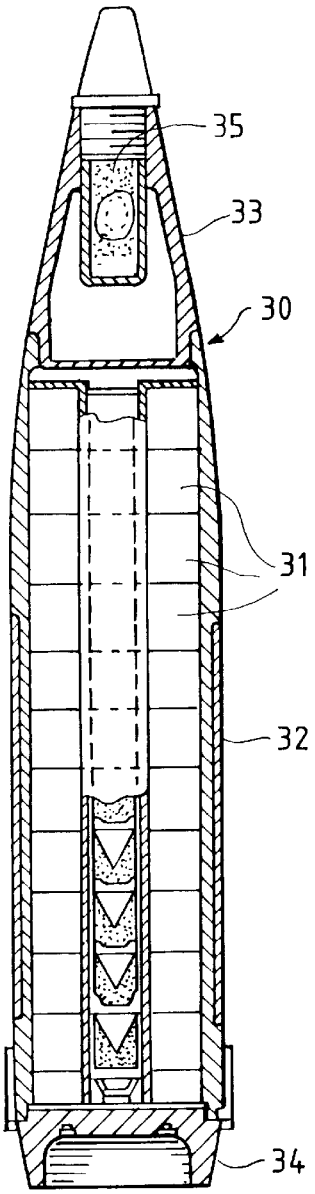
FIG. 9 is a sectional side elevation of a typical multiple-weapon or "cluster bomb" artillery munition, such as the United States Army 155 mm. M483 projectile containing 88 individual shaped-charge anti-personnel grenades, which is typical of the munitions which may be safely disposed of by the present invention.
Figure 10:
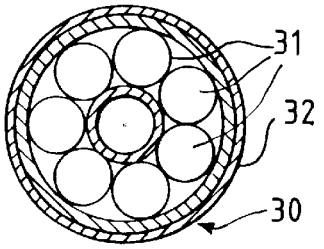
FIG. 10 is a sectional end view of the munition of FIG. 9, showing the individual grenades disposed in eight columns of ten units.
Figure 11:
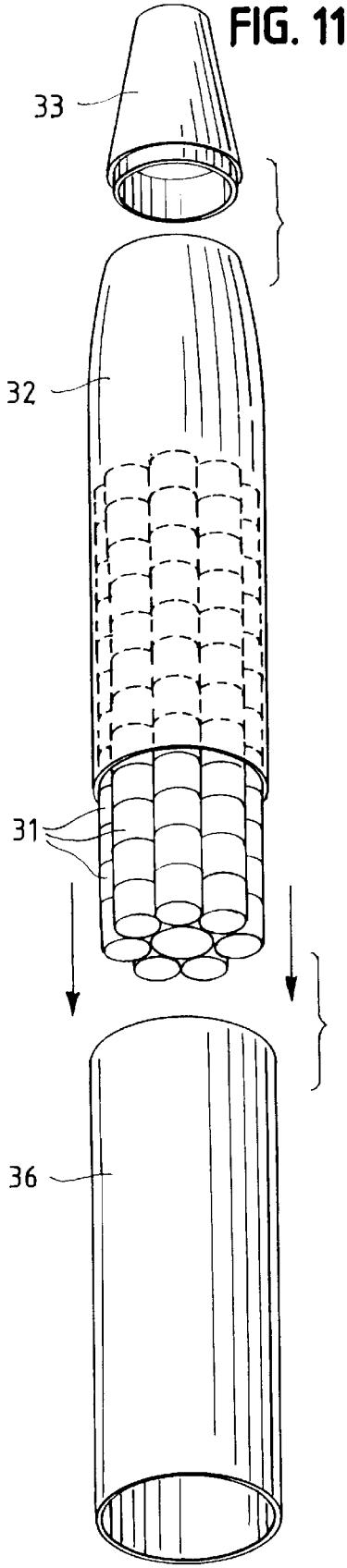
FIG. 11 is a perspective illustration of how the grenades within the munition of FIG. 9 are, according to the invention, expelled as a group into a plastic carrier tube, prior to being loaded into the FCU.
Figure 12:
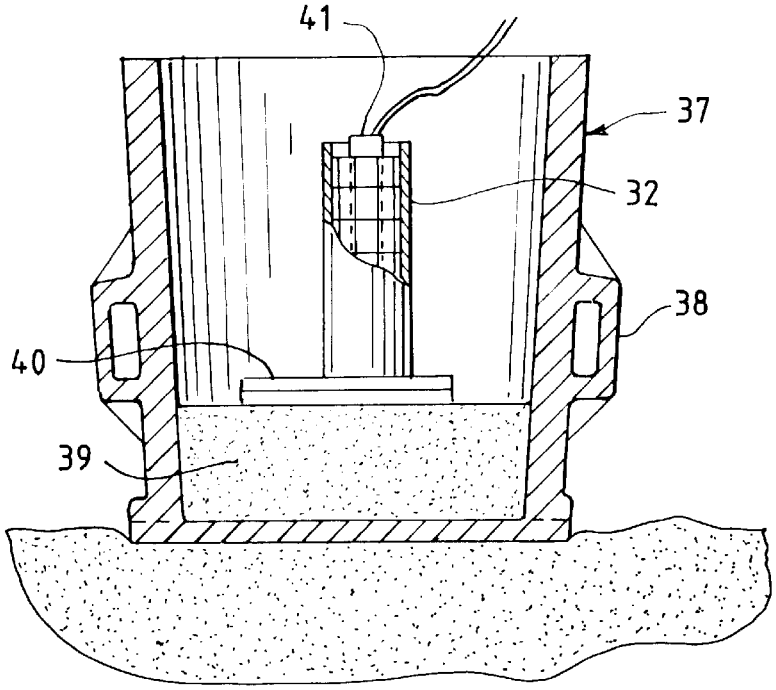
FIG. 12 is a side elevation of a fragmentation containment unit or FCU adapted for use with the explosion chamber of the preceding figures, containing the explosive contents of a cluster munition encased within the carrier tube of the preceding figure.
Figure 13:
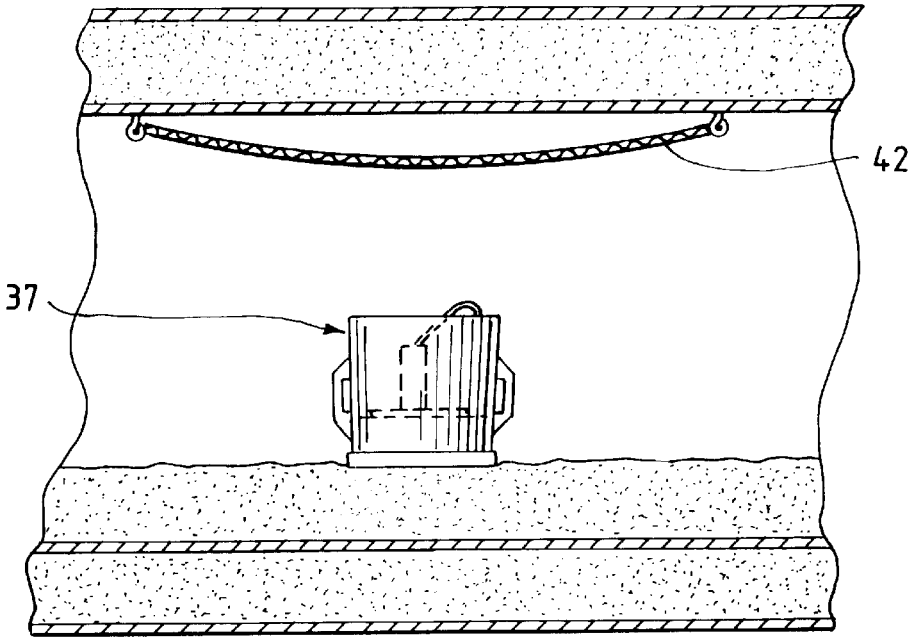
FIG. 13 is a partial sectional side elevation of a second preferred embodiment of the explosion chamber adapted for munitions disposal, showing the FCU containment unit of FIG. 12 positioned within the chamber and ready for the destruction of the contents of a munition positioned within the FCU.

A second embodiment of the invention, shown in FIGS. 11, 12 and 13, is particularly adapted for the destruction of surplus or defective munitions, particularly fragmentation munitions. FIGS. 9 and 10 illustrate one such munition 30, the United States Army M483 155 mm. "cluster bomb"

artillery shell, each of which contains a close-packed array of 88 individual miniature shaped-charge grenades or bomblets 31 arranged in ten layers of eight grenades each, all contained in a cylindrical shell adapted to be fired from a 155 mm. howitzer. The munition comprises a cylindrical metal body 32 closed at its forward end by a threaded cone or ogive 33 and at its base by a base plug 34. At the tip of the ogive 33 is a fuse and expulsion charge 35. When the munition is fired and approaches its target, the fuse ignites the expulsion charge 33, driving the array of grenades backward, causing the base 34 to separate from the body 32 and the individual grenades to disperse in the air. Once dispersed, each of the individual grenades is armed by a spinning ribbon fuse (not shown) and detonates on contact with any hard surface. The grenades each have a frangible metal shell which breaks apart into shrapnel fragments on detonation, and also a shaped-charge component designed to pierce armor.

To deactivate and dispose of such munitions, conventional techniques of hand disassembly and removal of explosive components are dangerously impractical because of the large number of small individual grenades contained in each cluster-bomb munition. Should the munition be suspected of being defective or unstable, the problems are multiplied even further.

In accordance with the second embodiment of the invention, a munition 30 intended for disposal is first stripped of its ogive 33 and base plug 34, thereby exposing and allowing access to the stacked array of individual grenades 31 from both ends of the shell. Then, a cylindrical carrier tube 36 of any suitable light organic plastic material such as polyvinyl chloride (PVC) is positioned in line with the open base end of the shell body 32. The entire array of grenades is then simply pushed as a single unit out of the shell body 32 and into the carrier tube 36 so that none of the grenades need be individually handled by the operator. This manipulation, because it is relatively simple, is also adapted to being performed by remote control through robotic manipulation means (not shown).

When the array of grenades 31 has been transferred from the shell body 32 into the carrier tube 36, the carrier tube is placed into the open-topped cylindrical container 37 referred to herein as the Fragmentation Containment Unit, or "FCU". The FCU 37 acts as a primary containment chamber for the detonation of the munition, serving to partially suppress and contain the explosion and to absorb the initial high-velocity impact of fragmentation shards and debris from the explosion. The gaseous explosion products and fragmentation debris not contained by the FCU are deflected and escape upwards into the containment chamber, which is constructed in the manner shown in FIGS. 1 through 8 and described in the preceding specification.

Preferably, the main explosion chamber intended for use with an FCU for the destruction of munitions has interior dimensions in which the side and end walls are of equal length, so that in plan view it is substantially square. It is also preferably constructed with greater interior height as well, all for the purpose of providing the greatest interior volume consistent with practical and reasonable construction techniques. In this embodiment of the invention intended primarily for munitions disposal, the chamber preferably is constructed with internal dimensions of sixteen feet on each side and a height of fourteen feet.

In the preferred embodiment shown in FIGS. 12 and 13, the interior diameter of the FCU at its mouth (upper end) is 42 inches, with a wall thickness of 3.5 inches, and a height of 48 inches. At its base, the FCU interior diameter tapers of 36 inches. The FCU 37 is preferably cast of manganese alloy steel, to give it impact-hardening characteristics and to make it more resistant to the impact of shrapnel fragments. On each side of the FCU are integral cast handle lugs 38 with openings adapted to receive the prongs of a fork-lift device (not shown), so that the FCU may be charged with a munition outside of the chamber, and then carried by fork-lift into the chamber and placed in position for detonation.

At the bottom of the FCU there is preferably placed a granular layer 39 of about 12 inches of energy-absorbing material such as silica sand. According to another aspect of the invention, on top of the sand layer 39 is placed a support platform 40 to keep the carrier tube 32 upright and centrally positioned within the FCU. The support platform is preferably made of one or more layers of gypsum board (hydrated calcium sulfate sheets with a paper covering). This inexpensive, readily available material is disintegrated entirely by the ensuing detonation with no detectable residue and provides a strong and stable flat surface on which to position the carrier tube 32 containing the array of bomblets 31 after removal from the munition.

Alternatively, a granular material may be used which can be mounded by hand into base for supporting an irregular-shaped munition (not shown). A hydrated granular mineral material such as commercially available cat litter has been found quite suitable for this purpose, and, like gypsum board, it leaves no residue after detonation.

Within the chamber, an interlocked steel blast mat 42 of woven steel cable or linked chain is suspended from the ceiling of the chamber directly overhead the FCU 37. The blast mat 42 serves to absorb the impact of any shrapnel fragments or debris not contained within the FCU.

As with the first preferred embodiment of the invention, liquid energy absorption modules are dispersed within the larger chamber in close proximity to the FCU to absorb and disperse the energy of the detonation of the munition. As before, these are preferably vaporizable containers comprising plastic film bags (not shown) filled with water, substantially evenly distributed in the space around and above the FCU by wire hangers in the manner previously described.

The mass of water to be used in the energy absorption modules has been found to be dependent upon the type of explosive to be detonated and its mass. Because the energy liberated per unit of explosive varies according to the type of explosive involved, for optimum blast suppression the mass ratio of water to explosive must also be varied. The following ratios have been determined to be substantially optimal for use with the types of explosives indicated:

| Explosive | Btu/lb | Water/Explosive Ratio |
|---|---|---|
| HMX | 3,402 | 2.50 |
| RDX | 2,970 | 2.20 |
| PETN | 2,700 | 2.00 |
| C-2 | 1,700 | 1.25 |

Once the FCU 37 has been charged with the munition to be disposed of, either as an array of grenades contained within the carrier tube 32 or as a separate munition, the FCU is picked up by a fork-lift (not shown) by means of its handle lugs 38 and placed within the explosion chamber as shown in FIG. 12. A small starter charge 41 is attached to the munition and wired for external initiation in the manner previously described.

With the FCU in place within the chamber, and the starter charge wired for ignition, the doors of the chamber are closed, and the closure is verified. The starter charge 41 is then detonated, thereby detonating the munition. The initial blast and fragmentation are substantially, but not completely, contained by the FCU, and the remaining force of the blast is thereby deflected and diverted upwards into the chamber itself. The explosion chamber, having a much greater containment volume than the FCU, serves to suppress and evacuate the gaseous explosion products in the manner previously described, while the fragmentation shards left behind are picked up and disposed of separately. The carrier tube 32, being of light PVC plastic, is essentially vaporized, as is the gypsum board support platform 40, so that there is virtually no other debris to be removed before the next munition is loaded for detonation.

Figure 14:
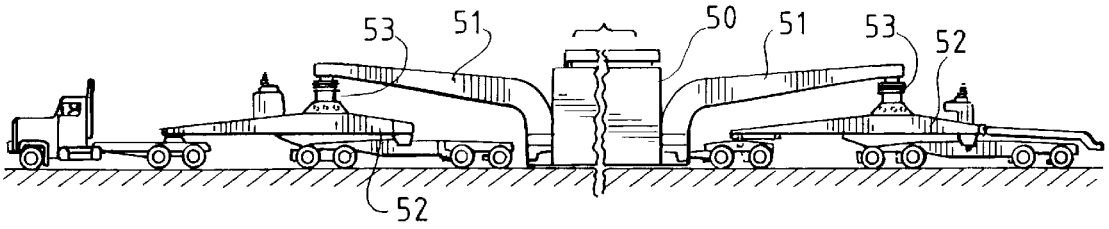
FIG. 14 is a side elevation of a transportable chamber embodying the present invention, showing an automotive tractor with fore and aft wheeled carriers for picking up, supporting, and carrying the chamber from one location to the next.

A transportable apparatus for controllably destroying munitions by detonation is shown in FIGS. 14–18. In FIG. 14, a mobile explosion containment chamber 50 is shown supported by detachable goose-neck arms 51, each of which is supported on one of two multiple-wheeled trailer units 52 by a pivoted hydraulic lift mechanism 53.

The internal structure of the mobile chamber 50 is similar to that of the previous embodiments, with certain modifications to make it more compact, and to allow its hollow walls to be easily filled with a pourable shock-damping means such as silica sand before use, and emptied again to prepare it for transport.

Figure 16:
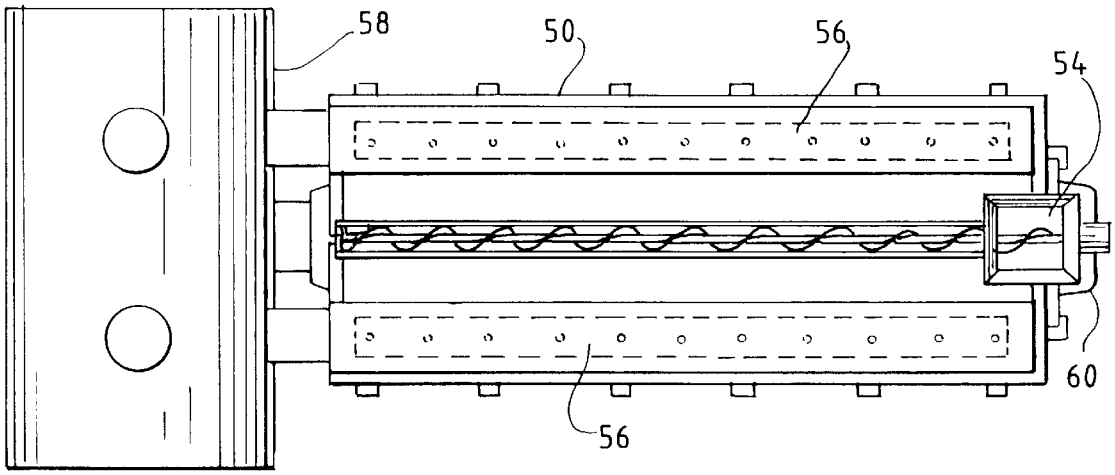
FIG. 16 is a plan view of the transportable chamber of FIG. 15.
Figure 15:
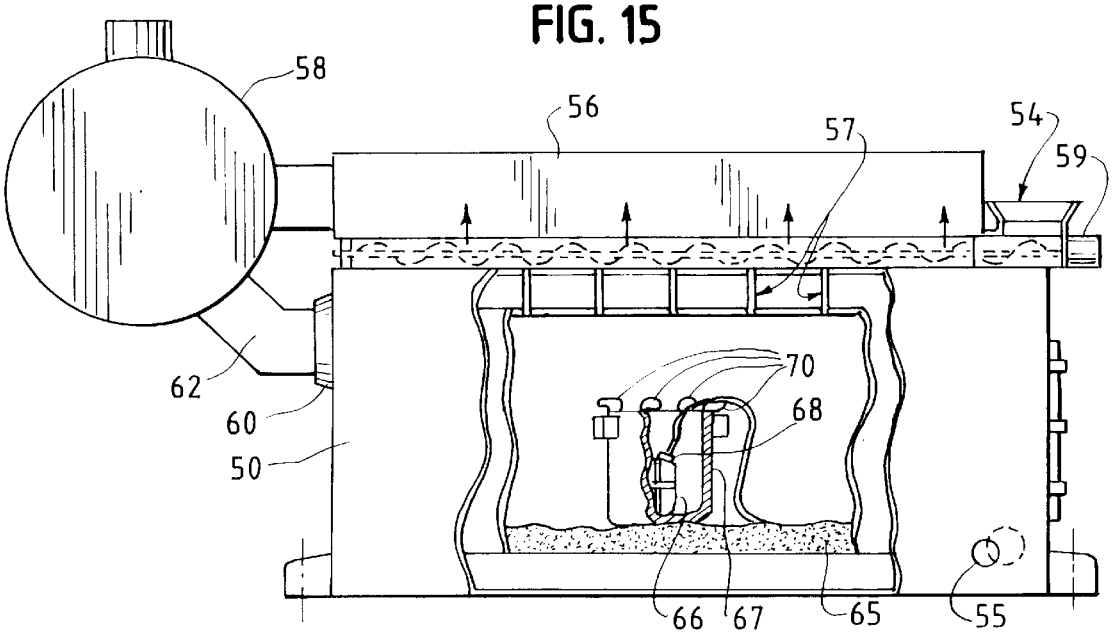
FIG. 15 is an enlarged partial cross-section side elevation of the transportable chamber of FIG. 14, showing an FCU containing a munition ready for detonation.
Figure 17:
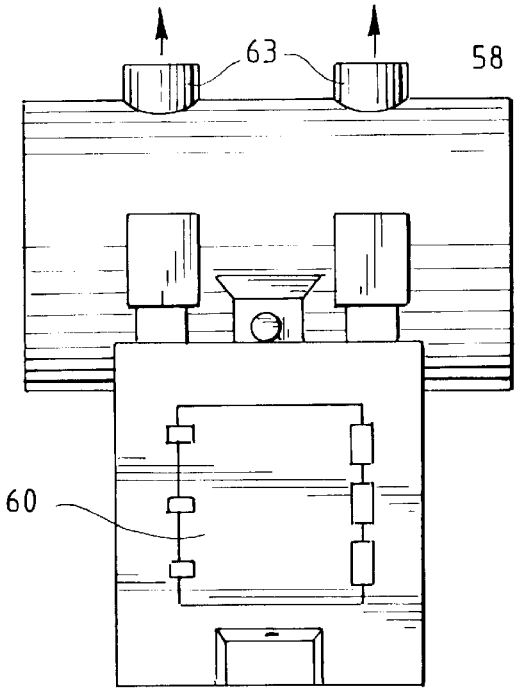
FIG. 17 is an end elevation of the transportable chamber of FIG. 15.

As best shown in FIGS. 15–17, the chamber is of double-walled welded steel construction, with the top, bottom and side walls each comprising steel plates spaced apart by steel I-beams to form a fillable wall cavity comprising hollow segments communicating horizontally across the chamber on the top and bottom, and vertically on the sides.

Figure 18:
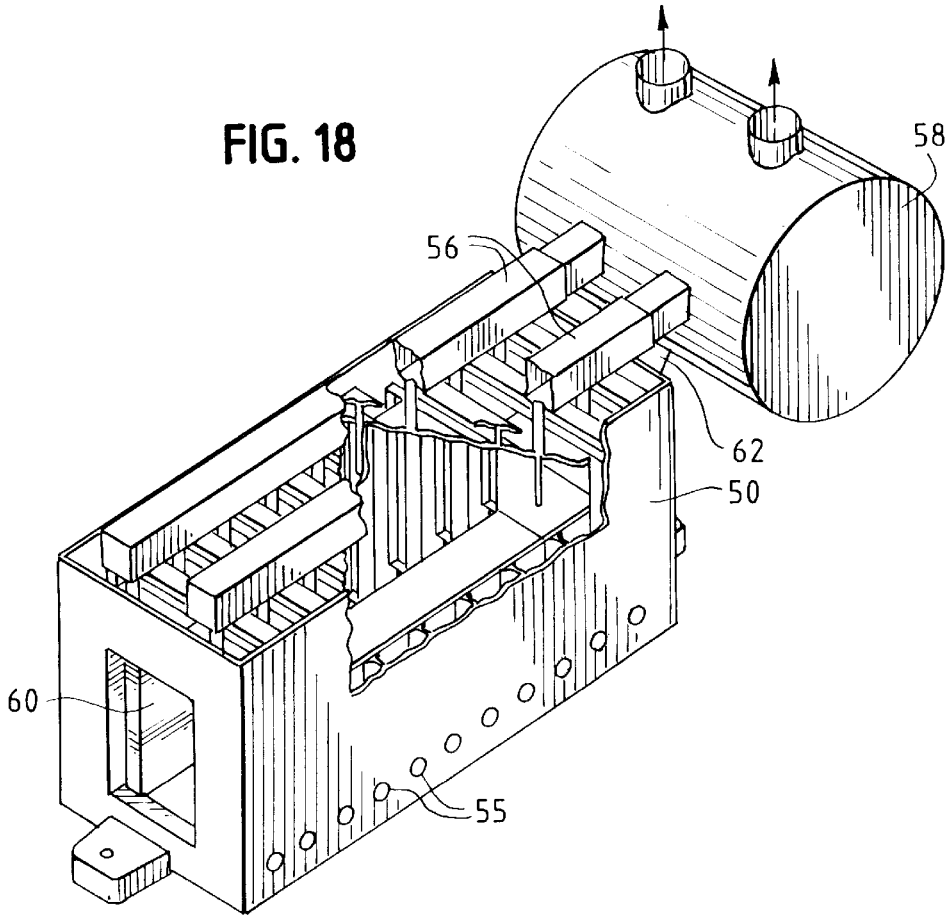
FIG. 18 is a perspective view in partial cross-section, showing the internal structure of the transportable chamber in association with one or more exhaust manifolds discharging into an expansion tank.

At the top of the chamber, suitable means for the introduction of silica sand is provided, such as a dump pit 54 and horizontal auger 59 for spreading the sand across the top of the chamber, where it is deposited into openings (not shown) which direct the sand into the hollow segments of the chamber top, and from which the sand will flow of its own weight down the side segments into the bottom segments, until all the segments are substantially filled with sand. The interconnection between the top and side wall segments is best shown in FIG. 18.

At the bottom of each wall segment of the chamber 50 is a suitable emptying means 55, such as a pivoted dump valve such as might be employed with a grain bin. When it is desired to lighten the chamber 50 for transport, the dump valves 55 are opened, and the sand, being flowable, discharges from each wall segment by its own weight. Any sand left can be easily removed by a vacuum ejector (not shown), such as is used for handling grain.

Atop the chamber 50 are steel manifolds 56 communicating with the interior of the chamber by an array of vent pipes 57 penetrating through the double walls, with each pipe terminating in a hardened steel orifice through which the explosion combustion products must pass. The manifolds 56 communicate in turn with an expansion tank 58 at the end of the chamber.

The chamber 50 has two openable blast-resistant doors consisting of a relatively larger front door 60 for workers to enter the chamber through, and a smaller rear door 61 for evacuating explosion products after each explosion. The rear door 61 is connected through an exhaust vent 62 to carry the explosion products into the expansion tank 58. The expansion tank 58 may be provided with scrubber means or other environmental control systems (not shown) to treat the explosion products before they are discharged through vent openings 63 into the atmosphere.

As shown in FIG. 15, the portable chamber 50 is prepared for use by providing a layer of pea gravel or other granular energy-absorbing material 65 as a floor. For the disposal of fragmenting munitions, the munition 66 is placed inside a bell-shaped cast steel shrapnel-containing fragmentation containment unit (FCU) 67 supported on the bed of pea gravel. To initiate detonation, an initiating charge 68 is placed atop the munition and detonated.

As with the previous embodiments of the invention, a principal feature is the provision of vaporizable bags or other containers filled with water 70, or other suitable energy absorbing units, in proximity to the munition 66 and initiating charge 68. The instantaneous vaporization of the water bags 70 serves to absorb and dissipate a substantial amount of the explosive energy. Also, the resulting water vapor, on condensation, assists in removing particulate combustion products from the exhaust gasses.

After the detonation, the rear door 61 is opened first, followed by the front door, and the exhaust products are drawn by fan means (not shown) into the expansion tank for further treatment, or for discharge through vents 63 to the atmosphere.

Dimensionally, the chamber 50 of this embodiment is sized to pass without substantial difficulty on public roads, being about 12 feet wide, 33 feet long, and 13 high. The two parallel manifolds atop the chamber are about 8 inches square, each being welded from ¼ inch rolled steel and having nine exhaust ports of 2 inch Schedule 160 steel pipe communicating to the interior of the chamber. The expansion chamber is 8 feet in diameter. All material is desirably of annealed rolled (AR) structural steel. The entrance (front) door is about 6 feet square, and the exhaust (rear) door is about 2 feet square. The fillable wall cavities are 19 inches thick, which is the height of the steel I-beams which separate interior and exterior walls. The empty weight of the chamber, with manifolds and expansion tank but without sand or pea gravel, is about 160,000 lb., of which 80,000 is supported by each wheeled trailer. When ready for use, the additional weight of the added sand and pea gravel is about 30,000 lb.

When it is desired to move the mobile chamber 50 to a new location, it is easily lightened by allowing the flowable silica sand to drain from the wall cavities by gravity, or by removing it using a vacuum ejector. The pea gravel bed may also be removed in a similar fashion. The goose-necks 51 are then reattached, the trailer units 52 moved into position, and the chamber is then raised up for travel clearance using the hydraulic lifts 53.

I claim:

1. A mobile device for containing and suppressing explosions comprising:

a pressure-resistant chamber having an inner casing and an outer casing surrounding and spaced from the inner casing, spacing means for connecting the inner and outer casings to define a fillable wall cavity therebetween, at least one access door penetrating said casings, and characterized by:

a wheeled carriage for transporting said chamber to a point of use;

filling means for filling the wall cavity with pourable granular shock-damping material prior to use, and emptying means for evacuating said shock-damping material after use.

2. The device of claim 1 including means for detaching said chamber from the wheeled carriage and lowering it onto a support surface for use, and means for raising and attaching said chamber onto said wheeled carriage for transport after such use.

3. The device of claim 1 in which the chamber has a floor covered with granular shock-damping material forming a support surface for an explosive object.

4. The device of claim 1 in which a plurality of liquid-filled energy absorption modules is positioned in a spaced array within the chamber with respect to an explosive object.

5. The device of claim 4 in which the energy absorption modules comprise vaporizable containers filled with water.

6. The device of claim 5 in which the containers are individual self-sealing polyethylene bags.

7. The device of claim 5, in which the mass of water is selected to match the energetic mass of the explosive object selected from the following table according to the principal explosive component of the object:

| Explosive | Btu/lb | Water/Explosive Mass Ratio |
|---|---|---|
| HMX | 3,402 | 2.50 |
| RDX | 2,970 | 2.20 |
| PETN | 2,700 | 2.00 |
| C-2 | 1,700 | 1.25 |

8. The device of claim 1 in which the chamber further includes a receiving and directing means for receiving and directing explosion products to a discharge point, and a plurality of spaced vent pipes communicating between the inside of the chamber and said receiving and directing means.

9. The device of claim 8 in which the chamber further includes a vent door and exhaust evacuation means for evacuating gaseous explosion products through the vent door and for drawing fresh air in through the access door.

10. The device of claim 9 in which the chamber further includes scrubbing means for stripping said explosion products of particulate matter and noxious vapors, and conveying means for conveying said explosion products from the discharge point and vent door to the scrubbing means.

11. The device of claim 1 further including a separate shrapnel-resistant containment vessel for receiving and containing a fragmentable explosive object within the chamber, and detonation means including an initiating explosive charge and ignition means for initiating the explosion of said object.

12. The device of claim 1 further including means for sensing the position of the access door, detonation means including ignition means and an initiating explosive charge, and means for electrically locking out the ignition means when said door is not in a closed and sealed condition.

13. A method for destroying an explosive object using a mobile explosion containing and suppressing chamber comprising the steps of:

providing a pressure-resistant chamber supported by a wheeled carriage means, and characterized by an inner casing and an outer casing surrounding and spaced from the inner casing, spacing means for connecting the inner and outer casings to define a fillable wall cavity therebetween, at least one access door penetrating said casings, filling means for filling the wall cavity with pourable granular shock-damping material prior to use, and emptying means for evacuating said shock-damping material after use, transporting said chamber on the wheeled carriage to a selected location for use, filling said fillable wall cavity with the pourable shock-damping material, destroying the object by attaching ignition means and an explosive initiating charge to said object, opening the access door, introducing the object into the chamber, closing and sealing the access door, and detonating the initiating charge, upon completion of object destruction, lightening the chamber for transport by evacuating the pourable shock-damping material from the chamber wall cavity, and employing the wheeled carriage to transport the chamber to another location.

14. The method of claim 13 including the steps of detaching said chamber from the wheeled carriage and lowering it onto a support surface for use, and raising and attaching said chamber onto said wheeled carriage for transport after such use.

15. The method of claim 13 including the step of placing a plurality of liquid-filled energy absorption modules within the chamber with respect to the object to be destroyed.

16. The method of claim 15 in which the energy absorption modules comprise vaporizable containers filled with water, and including the step of selecting the mass of water to match the energetic mass of the explosive object from the following table according to the principal explosive component of the object:

| Explosive | Btu/lb | Water/Explosive Mass Ratio |
|---|---|---|
| HMX | 3,402 | 2.50 |
| RDX | 2,970 | 2.20 |
| PETN | 2,700 | 2.00 |
| C-2 | 1,700 | 1.25 |

17. The method of claim 13 in which the chamber has a floor, and including the step of covering the floor with granular shock-damping material forming a support surface for the explosive object.

18. The method of claim 13 in which the chamber has a receiving and directing means for receiving and directing explosion products to a discharge point, and a plurality of spaced vent pipes communicating between the inside of the chamber and said receiving and directing means, and including the step of directing the explosion products from the vent pipes through the receiving and directing means to the discharge point prior to opening the access door for charging the next object.

19. The method of claim 18 including the step of directing the explosion products from the discharge point into a scrubbing means for stripping said explosion products of particulate matter and noxious vapors.

20. The method of claim 13 for use in destroying fragmentable explosive objects including the steps of placing the object in a separate shrapnel-resistant containment vessel positioned within the chamber prior to detonating the initiating charge.

21. The method of claim 13 including the step of sensing the position of the access door, and electrically locking out the ignition means when said door is not in a closed and sealed condition.

* * * * *

UNITED STATES PATENT AND TRADEMARK OFFICE

CERTIFICATE OF CORRECTION

PATENT NO. : 6,173,662 B1
DATED : January 16, 2001
INVENTOR(S) : John L. Donovan It is certified that error appears in the above-identified patent and that said Letters Patent is hereby corrected as shown below:

Column 12, claim 1,
Line 63, after "point of use", delete ";" and replace with -- , --.

Column 13, claim 13,
Line 59, after "wheeled carriage" delete "means".

Signed and Sealed this

Eleventh Day of December, 2001

*Attest:*

Nicholas P. Godici

NICHOLAS P. GODICI
*Acting Director of the United States Patent and Trademark Office*

*Attesting Officer*